US007368693B2

(12) United States Patent
Maeda

(10) Patent No.: US 7,368,693 B2
(45) Date of Patent: May 6, 2008

(54) MICROWAVE OVEN

(75) Inventor: Kazunori Maeda, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 200 days.

(21) Appl. No.: 11/038,150

(22) Filed: Jan. 21, 2005

(65) Prior Publication Data

US 2005/0173424 A1 Aug. 11, 2005

(30) Foreign Application Priority Data

Jan. 22, 2004 (JP) ..... 2004-013942

(51) Int. Cl.
*H05B 6/68* (2006.01)
*H05B 6/66* (2006.01)

(52) U.S. Cl. ..... 219/720; 219/702

(58) Field of Classification Search ..... 219/720, 219/506, 702, 428, 625, 663, 779, 626, 627; 116/67, 101; 340/500, 870.17, 501; *H05B 6/68, H05B 6/66*

See application file for complete search history.

(56) References Cited

U.S. PATENT DOCUMENTS 6,744,026 B2 * 6/2004 Ishikawa ..... 219/702

FOREIGN PATENT DOCUMENTS

JP 6-229567 8/1994

* cited by examiner

*Primary Examiner*—Daniel Robinson
(74) *Attorney, Agent, or Firm*—Bacon & Thomas, PLLC

(57) ABSTRACT

A microwave oven includes a heating chamber for heating and cooking foods, a heating unit for supplying heat energy to the heating chamber; a controller for controlling an operation of the heating unit, and an input unit for inputting cooking information into the controller. The input unit includes as one unit a display unit for displaying the cooking information to be inputted and an electrode unit having one or more switches directly formed on the display unit.

9 Claims, 5 Drawing Sheets

MICROWAVE OVEN

FIELD OF THE INVENTION

The present invention relates to a microwave oven in which a console has an input unit providing a desired cooking menu.

BACKGROUND OF THE INVENTION

Conventionally, in such type of a microwave oven, a sheet-shaped console switch unit serving as an input unit is formed by coupling a decorative sheet on which a cooking menu is printed and upper and lower printed electrode sheets that form switches (see, Japanese Patent Laid-open Application No. H6-229567).

Further, since a plurality of cooking patterns is stored in a memory, if a user selects a desired cooking menu by manipulating a control panel such as the sheet-shaped manipulating switch unit or the like, a microcomputer is used to operate a heating unit, e.g., a magnetron or the like, in accordance with the cooking patterns stored in the memory (see, U.S. Pat. No. 6,744,026).

FIGS. 4 and 5 show a conventional microwave oven disclosed in Japanese Patent Laid-open Publication No. H6-229567. As illustrated in FIGS. 4 and 5, the conventional microwave oven includes console's main body 1; microcomputer 2; printed circuit board 6 having thereon selecting unit 4 composed of jumper wire 3 and memory 5 for storing a plurality of cooking patterns; decorative sheet 7, e.g., a PET film having cooking menus printed thereon; and upper and lower printed electrode sheets 9*a* and 9*b* respectively having printed electrodes 8*a* and 8*b* on locations corresponding to positions where cooking menus are printed. Upper and lower printed electrode sheets 9*a* and 9*b* are connected to printed circuit board 6 as well as to microcomputer 2. Microcomputer 2 continuously detects which printed electrode is closed. If a user pushes a key for a desired cooking menu on decorative sheet 7, e.g., a key for milk, printed electrode 8*a* of third and fifth pins P3 and P5 makes a contact with printed electrode 8*b*, so that the circuit is closed. At this time, microcomputer 2 determines that the cooking menu of milk is selected and, thus, executes a process to operate a heating unit (not shown), e.g., a magnetron or the like, in accordance with a heating pattern for milk, which is stored in memory 5.

Meanwhile, microcomputer 2 selects one set from a plurality of cooking menu sets by using selecting unit 4 composed of jumper wire 3 provided on printed circuit board 6. For instance, in an American microwave oven, an American menu such as "popcorn", "bacon" and the like is selected from cooking menu sets of various countries by positioning jumper wire 3 at J1, whereas in a Japanese microwave oven, a Japanese cooking menu in which, "牛乳" and/or "ご飯" is warmed is selected by positioning jumper wire 3 at J2. In a decorative sheet for the American microwave oven, "popcorn" and "bacon" are printed, whereas one for the Japanese microwave oven, "牛乳" and "ご飯" are printed on decorative sheet 7.

In order to manufacture a microwave oven that can be used in several countries, it is configured such that exclusive decorative sheets are arranged to match with corresponding exclusive connection positions of jumper wire 3 for respective countries.

Since, however, decorative sheet 7 and upper printed electrode sheet 9*a* are separate components in the conventional configuration, a considerable force is needed to close the switch circuit by transforming the printed electrode sheet due to a thickness of decorative sheet 7 and that of upper printed electrode sheet 9*a*. Further, since they are of separate components, a menu print position printed on decorative sheet 7 can be misaligned with an electrode print position due to a deviation in an operation.

Moreover, if a position of jumper wire 3 attached to printed circuit board 6 is combined with wrong decorative sheet 7 when it being manufactured, in case a key for popcorn, for example, is pushed, a cooking of milk can be carried out. For this reason, a desired cooking performance cannot be achieved.

To solve such problem, an alternative route may be taken wherein the cooking menu sets are reduced by component standardization. However, in this case, an American cooking menu and a Japanese cooking menu have to be combined, for example, so that a microwave oven does not certainly meet the user's preference.

SUMMARY OF THE INVENTION

It is, therefore, an object of the present invention to provide a microwave oven capable of achieving a cooking performance suited for a user's preference and minimizing the possibility for making a mistake in manufacturing process with a simple configuration and an easy manipulation.

In accordance with a preferred embodiment of the present invention, there is provided a microwave oven including: heating chamber for heating and cooking foods; a heating unit for supplying heat energy to the heating chamber; a controller for controlling an operation of the heating unit; and an input unit for inputting cooking information into the controller, wherein the input unit includes as one unit a display unit for displaying the cooking information to be inputted and an electrode unit having one or more switches directly formed on the display unit.

In accordance with another preferred embodiment of the present invention, there is provided a microwave oven including: a heating chamber for heating and cooking foods; a heating unit for supplying heat energy to the heating chamber; a controller for controlling an operation of the heating unit; a memory unit for storing a plurality of cooking pattern sets; a selecting unit for selecting one cooking pattern set from the plurality of cooking pattern sets; and an input unit for inputting a desired cooking pattern, wherein the input unit includes an input portion for inputting a desired cooking pattern and a selective information for allowing the selecting unit to select a cooking pattern set to be selected.

In accordance with still another preferred embodiment of the present invention, there is provided a microwave oven including: a heating chamber for heating and cooking foods; a heating unit for supplying heat energy to the heating chamber; a controller for selecting a cooking pattern set and controlling an operation of the heating unit; an input unit for inputting a desired cooking pattern; and an attaching unit for attaching the input unit, wherein the attaching unit and the input unit are respectively provided with electrodes for forming key switches, and the key switches are formed by attaching the input unit to the attaching unit.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinafter, a preferred embodiment of the present invention will be described with reference to the accompanying drawings. Further, the present invention is not limited to the preferred embodiment.

Embodiment 1

Figure 1:
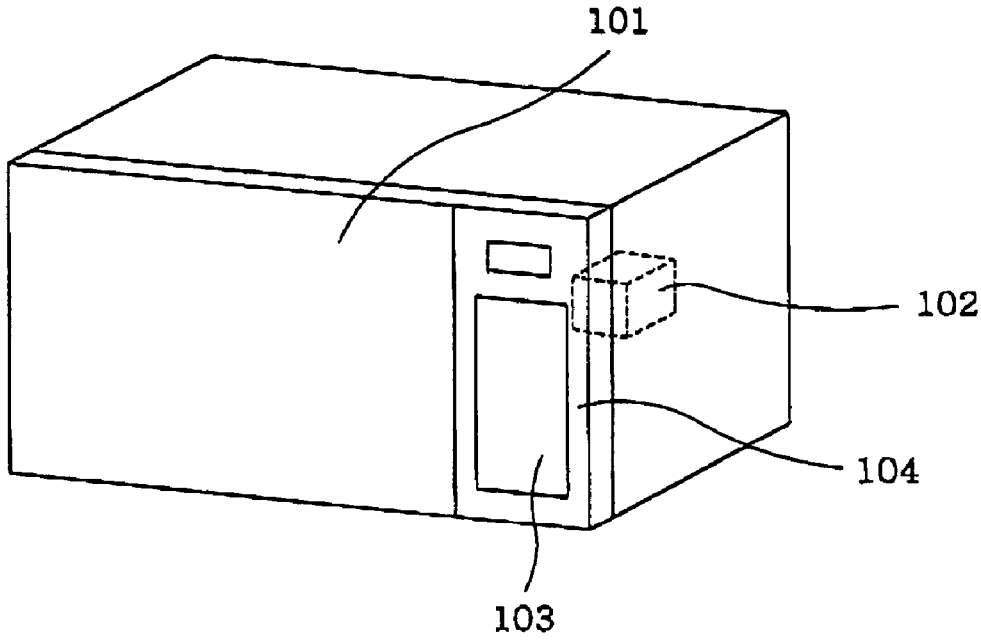
FIG. 1 shows an exterior perspective view of a microwave oven in accordance with a first preferred embodiment of the present invention.
Figure 2:
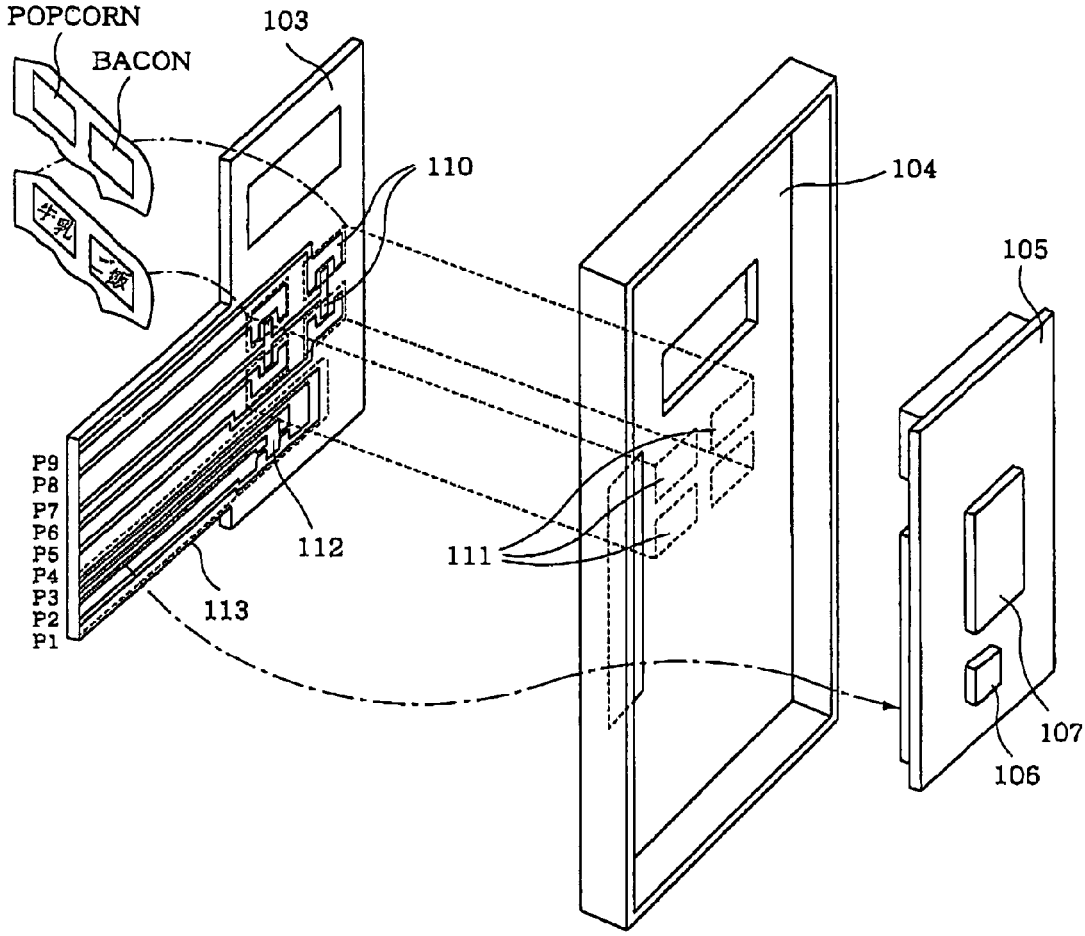
FIG. 2 illustrates an exploded perspective view for explaining major members of the microwave oven in accordance with the first preferred embodiment of the present invention.
Figure 3:
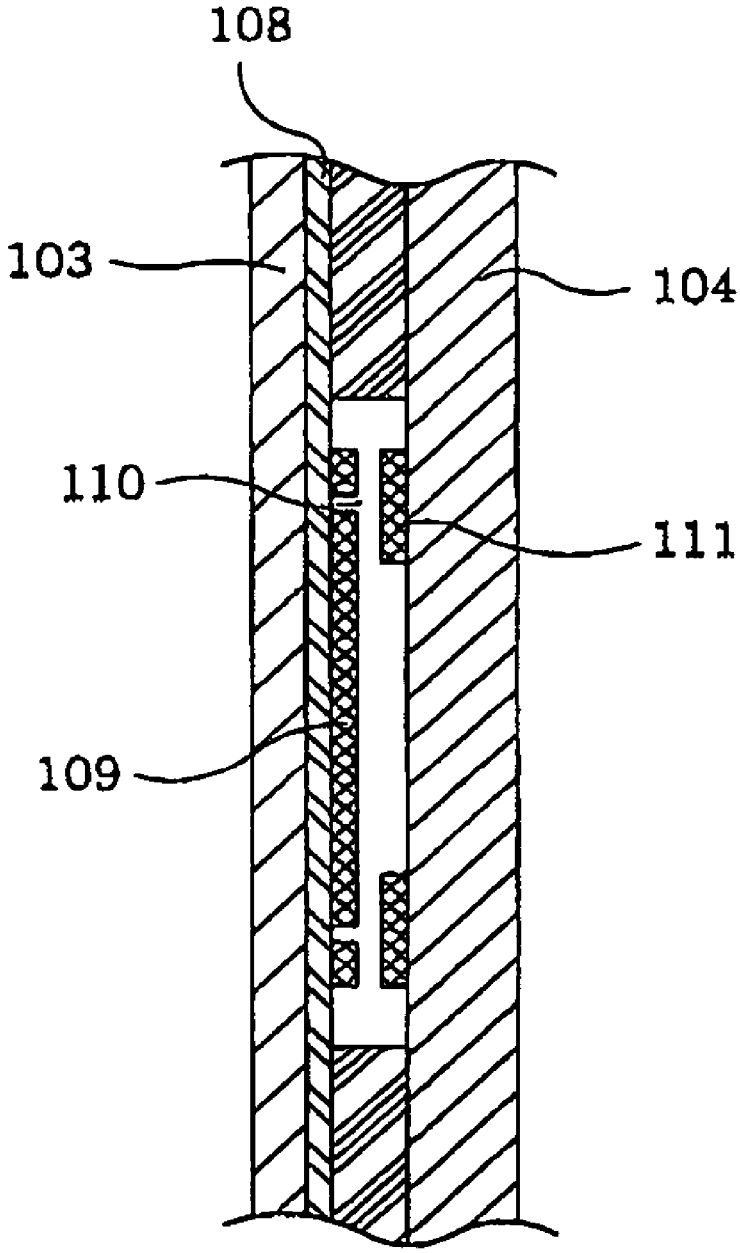
FIG. 3 provides a cross-sectional view depicting main parts of the microwave oven in accordance with the first preferred embodiment of the present invention.
Figure 4:
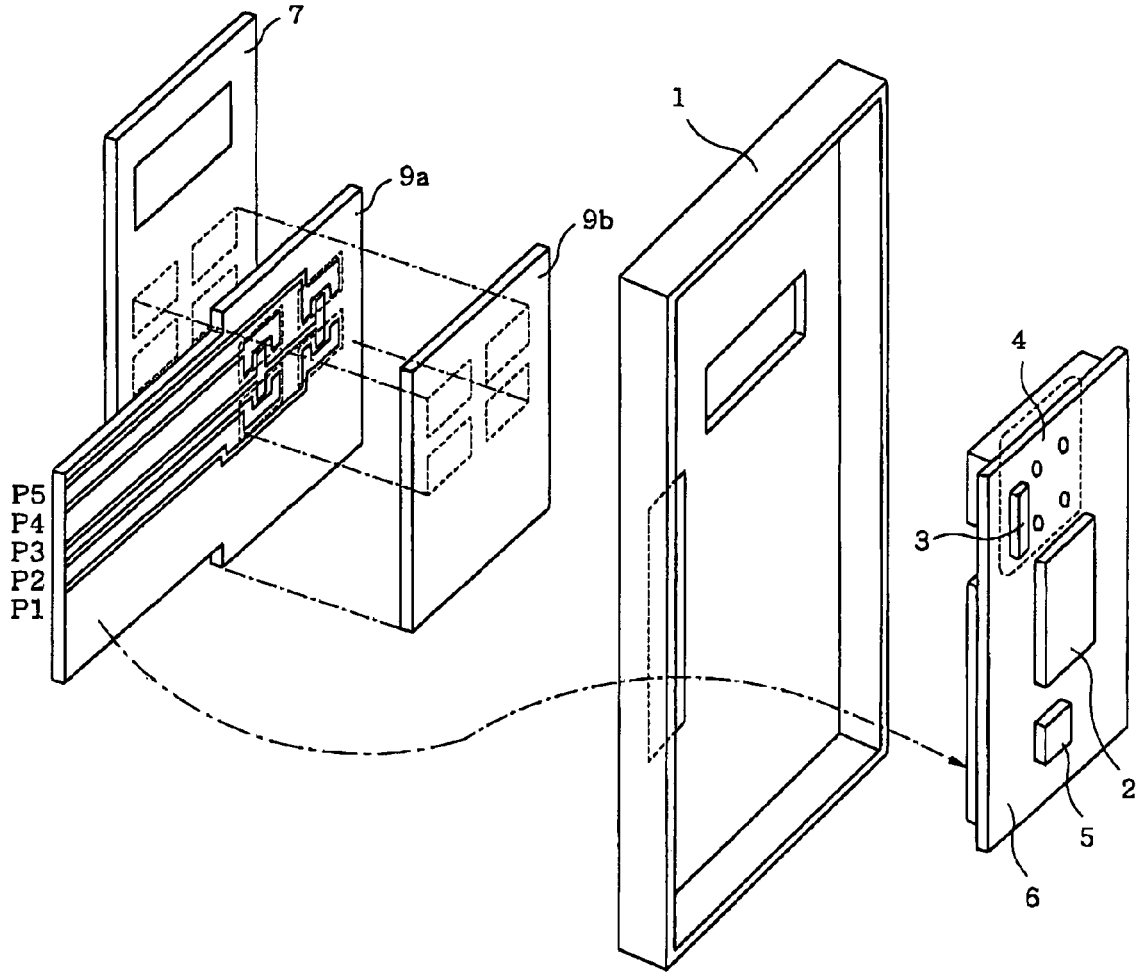
FIG. 4 (PRIOR ART)
FIG. 4 presents an exploded perspective view for explaining major members of a conventional microwave oven.
Figure 5:
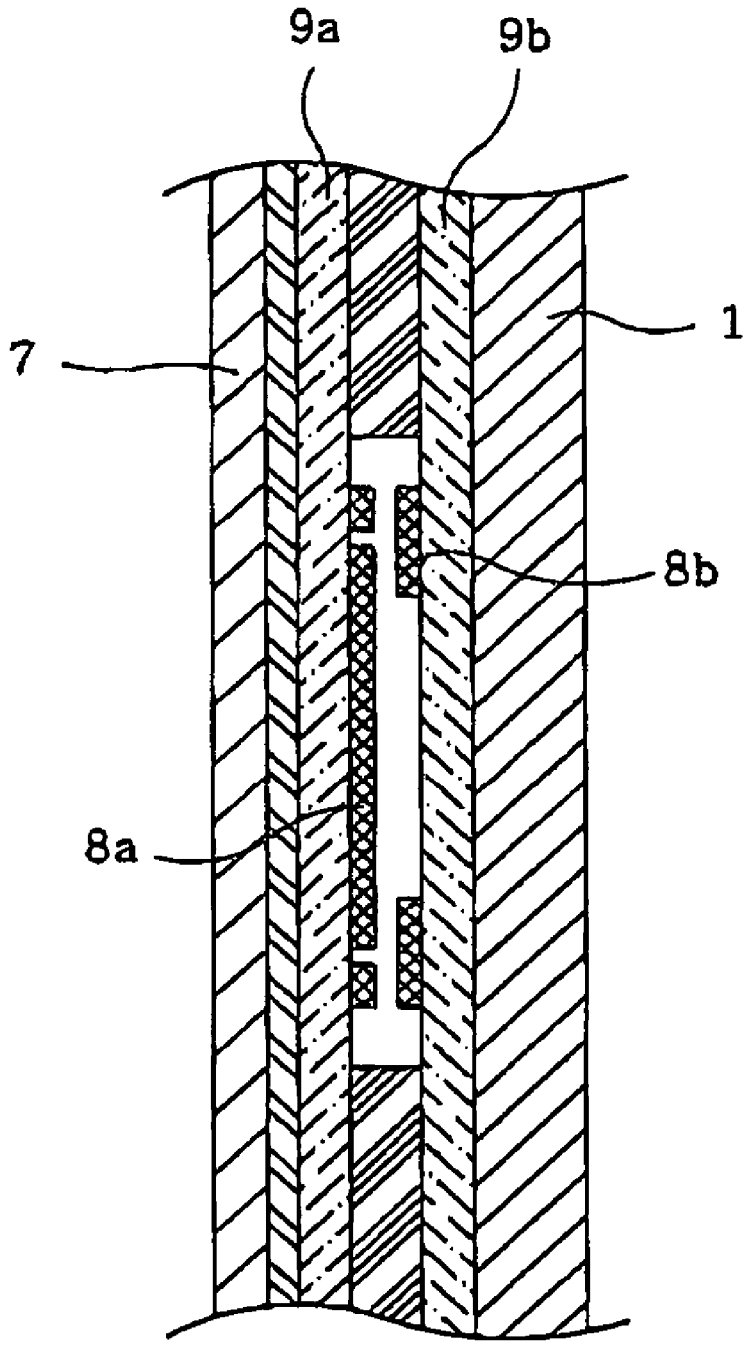
FIG. 5 (PRIOR ART)
FIG. 5 represents a cross-sectional view of main parts of the conventional microwave oven.

FIG. 1 shows an exterior perspective view of a microwave oven in accordance with a first preferred embodiment of the present invention; FIG. 2 illustrates an exploded perspective view for explaining major members of the microwave oven in accordance with the first preferred embodiment of the present invention; and FIG. 3 provides a cross-sectional view depicting main parts of the microwave oven in accordance with the first preferred embodiment of the present invention.

Referring to FIG. 1, heat energy is supplied to heating chamber 101 for heating and cooking foods contained therein by using heating unit 102 such as a magnetron or the like. Provided at a front surface of heating chamber 101 is console 104 having decorative sheet 103 on which a cooking menu is printed.

As shown in FIG. 2, printed circuit board 105 is attached to console (attaching unit) 104 and, further, memory (storing unit) 106 for storing a plurality of cooking patterns and microcomputer 107 are attached on printed circuit board 105. Instead of using separate memory 106 serving as a storing unit, a storage of microcomputer 107 can be used. As depicted in FIG. 3, menu printed layer (display unit) 108 for indicating a cooking menu written in English is provided on a backside of decorative sheet 103 and, further, printed electrode layer 109 is positioned on menu printed layer 108. As described in FIG. 2, comb-tooth-shaped upper electrodes 110 are formed as a part of printed electrode layer 109, and lower electrodes 111 are coated on console 104 so as to correspond to upper electrode 110. Such upper and lower electrodes 110 and 111 form key switches. Further, a part of printed electrode layer 109 forms model determination pattern 112.

Model determination pattern 112 and a pattern of upper electrode 110 are connected to printed circuit board 105 via connection portion 113 and, further, to microcomputer 107. As an example thereof, when first and second pins P1 and P2 are opened and, further, first and fourth pins P1 and P4 are short-circuited on model determination pattern 112, microcomputer 107 determines it is an American microwave oven. In another model determination pattern (not shown), for example, when first and fourth pins P1 and P4 are opened and, further, first and second pins P1 and P2 are short-circuited, microcomputer 107 determines that it is a Japanese microwave oven.

Microcomputer 107 reads model determination pattern 112 and selects a cooking pattern set corresponding thereto from cooking pattern sets for various countries stored in memory 106. When a user pushes upper electrode 110 to select a desired cooking menu, a switch corresponding to the desired cooking menu is closed. By detecting the closure of the switch, microcomputer 107 selects a cooking pattern corresponding thereto from the a plurality of cooking patterns of the selected cooking pattern set and executes a process to optimally operate heating unit 102, e.g., a magnetron or the like, thereby achieving an optimal cooking performance.

Hereinafter, the operation and the function of the microwave oven so configured as described above will be explained.

First of all, menu printed layer 108 for indicating a cooking menu and printed electrode layer 109 for selecting a desired cooking menu are provided on a backside of single decorative sheet 103. Therefore, electrodes of a key switch can be easily connected to each other by simply pushing single decorative sheet 103, so that the manipulation thereof becomes very easy.

Further, since lower electrode 111 is directly coated on console 104, the conventional electrode sheet for coating thereon the lower electrodes becomes unnecessary. Therefore, it is possible to reduce the manufacturing cost of the microwave oven.

In addition, menu printed layer 108 and printed electrode layer 109 are formed on the same sheet and, thus, menu print positions and electrode print positions corresponding thereto are unlikely to be misaligned, ensuring a desired cooking patterns to be performed correctly.

Besides, model determination pattern 112 matched with menu printed layer 108 is formed on the backside of decorative sheet 103, so that a desired cooking pattern set can be selected by simply attaching decorative sheet 103.

In this embodiment, an American menu is printed on decorative sheet 103 suited for an American user's preference, i.e., menu printed layer 108. If a "bacon" key is pushed after selecting an American cooking pattern set from model determination pattern 112, microcomputer 107 selects a heating pattern for bacon corresponding to an inputted key switch from cooking patterns of American cooking pattern set selected by model determination pattern 112, thereby controlling a heating unit, e.g., a magnetron or the like, to carry out an optimal operation for bacon. In case a Japanese decorative sheet is employed, when the user pushes a key for "牛乳" microcomputer 107 selects an optimal cooking pattern for "牛乳" similar to the American case, thereby controlling a cooking.

Moreover, since it is so unlikely that any defects are caused by a wrong combination of components, it is possible to provide an optimal cooking pattern suited for a user's preference by preparing multiple decorative sheets 103 and forming specific model determination patterns thereat in manufacturing a microwave oven. In this case, since decorative sheet 103 is the only thing that distinguishes one pattern from the other and cooking menu contents and model determination pattern 112 are physically of one unit, in other words, they are formed at a single decorative sheet 103, it is possible to minimize defects caused by mistakes occurring in assembling components during a manufacturing process.

As described above, in the embodiment, since menu printed layer 108 for indicating a cooking menu and printed electrode layer 109 are provided on decorative sheet 103, a correct manipulation can be effortlessly carried out. In addition, since model determination pattern 112 is provided on decorative sheet 103, a desired cooking pattern set can be selected only by attaching decorative sheet 103. Accordingly, it is possible to achieve a cooking performance suited for a user's preference and minimize mistakes in assembling components during a manufacturing process.

In the embodiment, there has been described a case where lower electrode 111 is directly printed on console 104. However, as in a conventional case, a lower printed electrode sheet can be used. In this case, even when positions of the electrodes are changed due to the number of cooking menus, a difference in the number of characters or the like, it is possible to change the positions of the electrodes only by exchanging the lower printed electrode sheet without changing the print positions of console 104, which can facilitates the manufacturing process.

Further, it is also possible to form decorative sheet 103 and the lower printed electrode sheet as one bended unit. In this case, it is possible to simultaneously print upper electrode 110 and lower electrode 111 and, further, a correct manipulation can be achieved while preventing a positioning misalignment of the printed electrodes.

Moreover, model determination pattern 112 may be provided at connection portion 113. In this case, a wider area of decorative sheet 103 can be effectively used as a cooking menu portion for selecting a menu. For example, since characters of a cooking menu or an area of upper electrode 110 can be enlarged, it is easy to read and, further, a correct manipulation can be performed. Therefore, a user's convenience can be enhanced.

Besides, decorative sheet 103 may be configured to be detachable. In this case, a new cooking menu can be selected from the same microwave oven only by exchanging decorative sheet 103 for one having a model determination pattern different therefrom. For example, if there is a Japanese user living in America, the user can convert a microwave oven purchased in America into one same as the one purchased in Japan by simply inserting Japanese decorative sheet 103 thereto, so that the user can prepare an exactly same menu in an exactly same way as being prepared by using an oven purchased in Japan, which improves a user's convenience.

The input unit can be formed by a keyboard having a plurality of key switches. Further, the keyboard has electrode circuit printed thereon and the electrode circuit may have selective information for selecting a single cooking pattern set from a plurality of cooking pattern sets. With such configuration, the key switches and the electrode circuit can be simultaneously formed. Accordingly, the manufacturing process can be facilitated and, further, mistakes in assembly can be minimized during the manufacturing process.

Further, although the present embodiment has been described for a case where the input unit performs a model determination by using a printed electrode pattern, another unit can be employed. For instance, by connecting to the Internet, it is possible to change the original menu set into new one or add a new cooking menu that is not stored in memory 106. With such configuration, a new cooking menu can be always selected without changing a microwave oven's main body, so that the user's convenience can be improved.

Furthermore, the input unit may be provided with an IC tag. In this case, more information can be stored in comparison with that obtained by changing the printed pattern. Accordingly, a more detailed cooking pattern can be selected. For example, it is possible to select a menu for Japanese seniors or that for American children, thereby improving the user's convenience.

As describe above, the microwave oven in accordance with the present invention can be easily manipulated with a simple configuration and, further, a cooking performance suited for a user's preference can be achieved. Thus, it can be applied to a cooking apparatus in which a console has an input unit or the like.

While the invention has been shown and described with respect to the preferred embodiments, it will be understood by those skilled in the art that various changes and modification may be made without departing from the spirit and scope of the invention as defined in the following claims.

What is claimed is:

1. A microwave oven comprising:

a heating chamber for heating and cooking foods;

a heating unit for supplying heat energy to the heating chamber;

a controller for controlling an operation of the heating unit; and an input unit for inputting cooking information into the controller, wherein the input unit includes as one unit a display unit for displaying the cooking information to be inputted and an electrode unit constituting parts of switches, the electrode unit being directly formed on the display units, wherein the input unit includes a pair of sheets facing each other, and at least one of the sheets has an electrode layer for transmitting an electric signal to the controller and a print layer for displaying a cooking menu.

2. The microwave oven of claim 1, wherein the pair of sheets forming the input unit are formed by bending a single piece.

3. A microwave oven comprising:

a heating chamber for heating and cooking foods;

a heating unit for supplying heat energy to the heating chamber;

a controller for selecting a cooking pattern set and controlling an operation of the heating unit;

an input unit for inputting a desired cooking pattern; and an attaching unit for attaching the input unit, wherein the attaching unit and the input unit are respectively provided with electrodes for forming key switches, and the key switches are formed by attaching the input unit to the attaching unit.

4. The microwave oven of claim 3, wherein the input unit is detachably attached to the attaching unit.

5. The microwave oven of claim 1, wherein an electric signal between the input unit and the controller is transmitted via Internet, and a menu set of the microwave oven is replaced with a new menu set by using the Internet.

6. The microwave oven of claim 3, wherein an electric signal between the input unit and the controller is transmitted via Internet.

7. The microwave oven of claim 1, wherein the input unit further includes an IC tag.

8. The microwave oven of claim 3, wherein the input unit further includes an IC tag.

9. The microwave oven of claim 1, wherein the display unit is a menu printed layer for indicating a cooking menu provided on a backside of a decorative sheet and the electrode unit is positioned on the menu printed layer.

* * * * *

UNITED STATES PATENT AND TRADEMARK OFFICE

CERTIFICATE OF CORRECTION

PATENT NO. : 7,368,693 B2
APPLICATION NO. : 11/038150
DATED : May 6, 2008
INVENTOR(S) : Kazunori Maeda It is certified that error appears in the above-identified patent and that said Letters Patent is hereby corrected as shown below:

In column 6, line 28, (claim 1, line 12), please change "display units" to --display unit--.

Signed and Sealed this

Twenty-eighth Day of July, 2009

JOHN DOLL
*Acting Director of the United States Patent and Trademark Office*